US010955230B2

(12) United States Patent
Szabados

(10) Patent No.: US 10,955,230 B2
(45) Date of Patent: Mar. 23, 2021

(54) DIE REMOVAL DEVICE

(71) Applicant: Andreas Szabados, Grünwald (DE)

(72) Inventor: Andreas Szabados, Grünwald (DE)

( * ) Notice: Subject to any disclaimer, the term of this patent is extended or adjusted under 35 U.S.C. 154(b) by 0 days.

(21) Appl. No.: 16/499,679

(22) PCT Filed: Mar. 27, 2018

(86) PCT No.: PCT/EP2018/057823
§ 371 (c)(1),
(2) Date: Oct. 21, 2019

(87) PCT Pub. No.: WO2018/178105
PCT Pub. Date: Oct. 4, 2018

(65) Prior Publication Data

US 2020/0116464 A1 Apr. 16, 2020

(30) Foreign Application Priority Data

Mar. 28, 2017 (DE) ..... 10 2017 106 600.4

(51) Int. Cl.
*F42B 33/10* (2006.01)

(52) U.S. Cl.
CPC ..... *F42B 33/10* (2013.01)

(58) Field of Classification Search
CPC ..... F42B 33/00; F42B 33/10
USPC ..... 86/23, 24
See application file for complete search history.

(56) References Cited

U.S. PATENT DOCUMENTS 3,107,575 A * 10/1963 Paul ..... F42B 33/10 86/44
3,974,736 A 8/1976 Minko
4,273,024 A 6/1981 Veloni
4,510,842 A * 4/1985 Hlusko ..... F42B 33/10 86/24
5,621,957 A 4/1997 Herrera et al.
8,931,156 B1 1/2015 Zimmer et al.
10,295,322 B1 * 5/2019 Burke ..... F42B 33/02
2004/0025677 A1 * 2/2004 Koch ..... F42B 33/10 86/24
2012/0160081 A1 * 6/2012 Beebe ..... F42B 33/10 86/24

* cited by examiner

*Primary Examiner* — Bret Hayes
(74) *Attorney, Agent, or Firm* — Dragon Sun Law Firm, PC; Jinggao Li, Esq.

(57) ABSTRACT

A device (2) for pulling a cartridge case (4) in a pulling direction (10) out of an axial bore of a die (6) which, as seen from the axial bore, comprises a male thread (20) on the outside to hold the die (6) in a reloading press is provided. The device (2) comprises:

a support plate (12) for holding the die (6) aligned with its axial bore in the pulling direction 10) and secured against a movement in the pulling direction (10) in a die bore (18)

a lifting plate (14) arranged at a distance (16) before the support plate (12) as seen in the pulling direction (10), comprising a pulling element (24) with retaining members aligned against the pulling direction (10), wherein the retaining members are arranged in such a way to hold the cartridge case (4) at an end of the pulling element (24) opposite the lifting plate (14), and drive members (32, 34) for driving the support plate (12) and the lifting plate (14) apart in and/or against the pulling direction (10).

15 Claims, 5 Drawing Sheets

DIE REMOVAL DEVICE

FIELD OF THE INVENTION

The invention relates to a device for removing cartridge cases stuck in a die in accordance with claim 1.

BACKGROUND

Sports shooters and hunters often load empty cartridge cases, which brings not only financial benefits but also better results than factory-loaded ammunition. For reconditioning empty cartridge cases, a trimmer calibration device is already known from DE 10 2013 020 748 B3 which is used to process the interior and exterior dimensions of cartridge cases in a die body by means of a milling machine, which is also known as trimming. Firing a cartridge case usually leads to an increase in its diameter along its entire length, as well to a linear expansion of the cartridge case.

A reloading press for cartridge cases is known from DE 400 83 82 C2. DE 10 2004 04 64 62 A1 describes a combined setting and trimming die for reloading devices for cartridge cases. Reloading empty cartridge cases is also known from U.S. Pat. Nos. 3,204,518 A and 2,571,272 A.

The problem, however, that arises over and over again in all these devices, is that the cases are stuck in the calibrated die and can only be removed forcibly or not at all, wherein the die may be damaged and/or become unusable. This can cause great effort and trouble as well as added costs.

In general, cartridge cases to be filled should be calibrated by a die before reloading. As already mentioned, stuck cartridge cases are a major problem if they have to be removed from the calibrating tool, i.e. the die.

In particular, there is a risk of the cartridge case being deformed to a different dimension, wherein it is very difficult to remove the stuck cartridge case, in particular when the upper edge of the cartridge case is damaged. This may be caused by material fatigue after repeated reloading of the cartridges, or by an inferior quality of the material, a too-soft brass alloy or improper use. Even if the edge of the cartridge is not damaged, it is often impossible to remove the cartridge from the die.

Removing a cartridge stuck in a die by the known devices often fails in practice. The reasons for this are as follows:

- material fatigue
- insufficient quality of the brass alloy
- incorrect or off-vertical bore hole and thus an inclination of the thread.

The force to remove a stuck cartridge from the die exceeds the load capacity of the devices used, which usually ends up with the fixing screw being torn out of the thread of the bottom of the cartridge. The effort to remove said stuck cartridge is considerable and often causes the polished inner surface of the die to be damaged so that the die can no longer be used or only to a limited extent.

The salvage of dies according to the current state of technology is uncertain, and often fails due to the said reasons. After an unsuccessful attempt, it is very work-intensive to remove the cartridge from the tool, and the expensive die may end up being damaged, wherein it is often no longer suitable for further use, because the inside tolerances have changed. The calibration tolerances of a cartridge are extraordinarily small which has two fundamental reasons:

1. Safety of the rifle/pistol/revolver used and thus the safety of the persons operating this equipment.

2. The accuracy of the bullets which in many ways is also an absolutely necessary safety factor.

SUMMARY

The task of the invention is, therefore, to create a device for safely removing cartridge cases stuck in a die without the die being damaged.

This task is solved by the characteristics stated in claim 1. Advantageous embodiments and further embodiments of the invention can be taken from the sub-claims.

The basic concept of the invention is to arrange a support plate and a lifting plate with a certain distance between them, wherein a die is screwed into the support plate to accommodate the stuck cartridge case to be processed. The die can be positioned against this plate by a male thread and, optionally, be fixed additionally by a lock nut. The lifting plate and the support plate can be moved further away from one another by drive members. Such drive members can be of the manual or electrical-automated kind. To move the lifting plate and the support plate further away from one another, preferred drive members are jack screws being screwed into the support plate and thus pushing the lifting plate away from the support plate. The lifting plate is provided with a pulling element with retaining members holding the cartridge case to be removed from the die on the lifting plate. If the lifting plate is now moved away from the support plate by means of the drive members, the die held onto the support plate also moves away from the cartridge case held on the lifting plate. The lifting plate thus has a passive lifting function.

The pulling element with the retaining members may comprise a thread as retaining member which is screwed into a case bottom of the cartridge case. In this way, the pulling element holds the cartridge case on the lifting plate and supports it there.

If the drive members described above comprise jack screws, the two jack screws can be screwed evenly to lift the lifting plate, wherein the lifting plate moves away from the support plate and pulls out the cartridge case from the die via the traction bolt in the case bottom. The die itself is retained on the support plate as described above. In this way, the pulling element holding the cartridge case is functionally released, so that the force can be transmitted to the case bottom without interruption and in an optimum way. Any tiny defects in the bore hole, such as an inclined bore hole, as well as material defects or quality problems play only a subordinate role. Said device thus protects the interior and exterior of the die. The support plate for retaining the die may be made of simple and inexpensive material.

An alternative to the above mentioned jack screws as drive members would be, for example, to separate the support plate and the lifting plate simply by means of a vice. Alternatively, the support plate could also be held in a vice, wherein the lifting plate and the support plate are pushed apart with the said jack screws.

According to another embodiment of the invention, the lifting plate and the support plate can be positioned relative to each other by means of guide pillars, so that the plates cannot be twisted against each other and the handling of the die saver in the fixed position of the plates is facilitated. The lifting plate is movable along the guide pillars relative to the support plate. It should further be noted that the screws for adjusting the distance between support plate and lifting plate may also be wing screws, so that no tool is necessary to operate the device.

According to an aspect of the invention, a device for pulling a cartridge case in a pulling direction out of an axial bore of a die, comprising outside a male thread for holding the die in a reloading press as seen from the axial bore, comprises a support plate for holding the die, with its axial bore aligned in the pulling direction and secured against movement in the pulling direction in a die bore, a lifting plate as seen in the pulling direction arranged at a distance before the support plate, on which a pulling element is arranged with retaining members aligned against the pulling direction, wherein the retaining members are executed to hold the cartridge case on an end of the pulling element opposite the lifting plate, and drive members to separate the support plate and the lifting plate in and/or against the pulling direction.

In one embodiment of the specified device, the retaining members may comprise a thread which can be screwed into the cartridge case.

In an additional embodiment of the specified device, the pulling element may comprise a screw with a screw head which is screwed into the lifting plate against the pulling direction.

In one special embodiment of the specified device, the drive members may comprise a jack screw screwed through the support plate in the pulling direction which is supported on the lifting plate, wherein the lifting plate may be moved in the pulling direction by screwing the jack screw into the support plate.

In another embodiment of the specified device, the drive members seen from the jack screw opposite the die may comprise another jack screw, screwed through the support plate in the pulling direction. Said jack screw is supported on the lifting plate, wherein the lifting plate is movable in the pulling direction by screwing the both jack screws into the support plate.

In another embodiment of the specified device, a distance between both jack screws and the die bore may be equal as seen at a right angle to the pulling direction.

In another embodiment of the specified device, at least one of the jack screws or all jack screws may be wing screws. Alternatively or additionally, the jack screw or also all jack screws may be aligned in the guiding direction.

In another embodiment of the specified device, the two jack screws and the die bore may be arranged in a plan view on the support plate and the lifting plate in the pulling direction along a straight line.

In an additional embodiment, the specified device may comprise a locknut which can be screwed on the male thread of the die to fix the die on the support plate. For this purpose, the locknut may be arranged optionally on a side of the support plate away from the lifting plate.

In an additional embodiment of the specified device, the support plate and the lifting plate may be held against each other while being guided in the pulling direction.

In one preferred embodiment of the specified device, the guiding element may comprise at least one linear rail, on which the lifting plate and the support plate are held while remaining movable relative to one another. In a particularly preferred embodiment, the guiding element may comprise at least four linear rails which are arranged symmetrically to the centre of the die bore. For this purpose, at least one linear rail may be attached to the support plate or the lifting plate.

BRIEF DESCRIPTION OF THE DRAWINGS

The invention is described in more detail in the following using embodiments in combination with the drawing. It shows.

The same reference signs in the individual figures refer to the same parts and will only be described once.

DESCRIPTION

Figure 1:
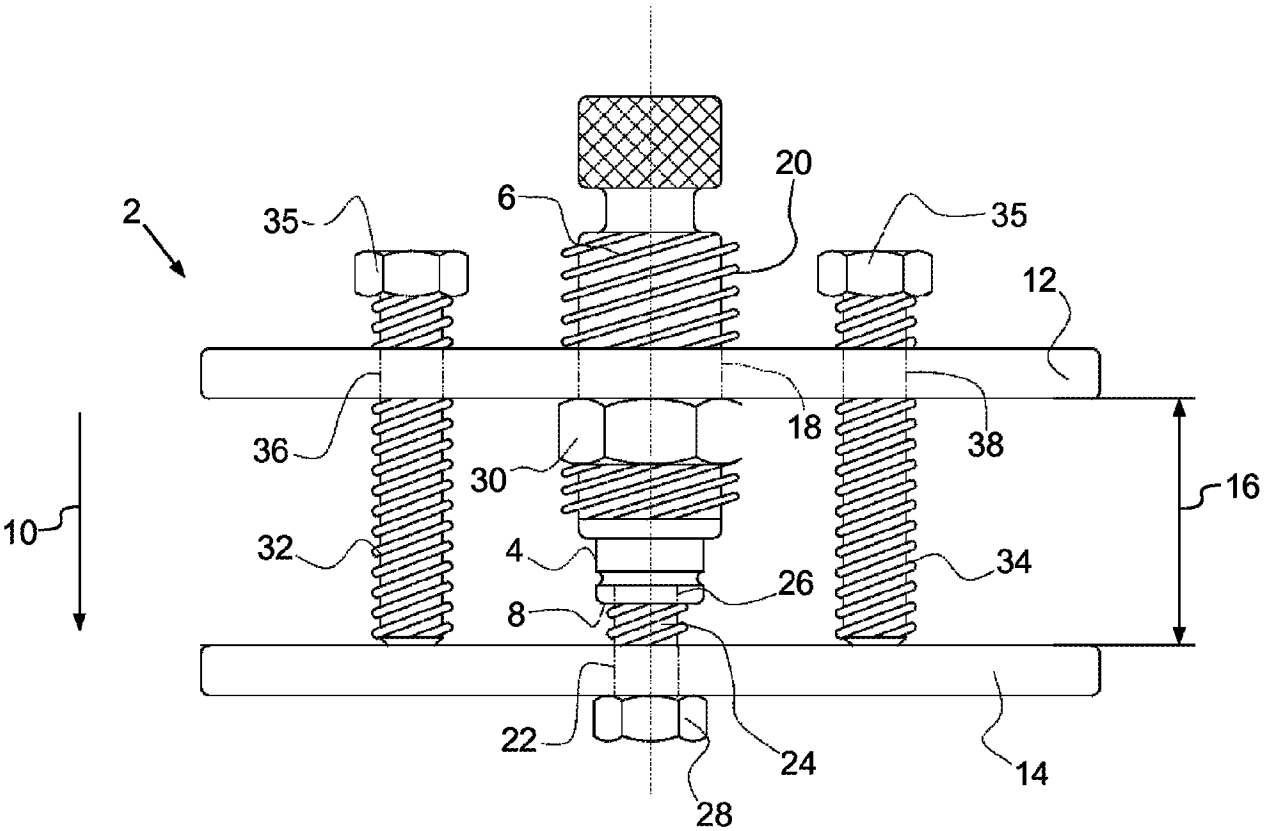
FIG. 1 a device for pulling a cartridge case out of a die in accordance with a first embodiment.

FIG. 1 shows a device 2 for pulling a cartridge case 4 out of a die 6, as described, for example, in DE 10 2013 020 748 B3, in accordance with a first embodiment. Such dies 6 are used in the field of shooting sports and hunting when refilling empty cartridges in reloading presses and are very well known per se. Therefore, the design of the die 6 will not be described in any more detail here.

The die 6 comprises in a manner known per se a central axial bore, into which a cartridge case 4 may be pressed for trimming and calibration purposes. If the cartridge case 4, however, is stuck in the central bore and cannot be removed easily, the die 6 with the cartridge case 4 stuck in it is useless. Usually, the bottom 8 of the cartridge case 6 protrudes from the die 6, so that the bottom 8 of the die 6 sticks out. This is where the device 2 described in the following fulfils its purpose of saving such a die 6 by pulling out the cartridge case 4 stuck in it in a pulling direction 10.

The device 2 comprises a support plate 12 which is arranged perpendicularly to the pulling direction 10 as well as a lifting plate 14 which is arranged perpendicularly to the pulling direction 10, both being arranged in relation to each other at a specified plate distance 16, as seen in the pulling direction 10.

The support plate 12 comprises a die bore 18 running in the pulling direction 10 with a female thread which is not shown in the figures, into which the die 6 can be screwed using a male thread 20 executed on the die 6 in a manner known per se. The die 6 is thus screwed into the support plate 12 with the bottom 8 of the cartridge case 4 pointing to the lifting plate 14. The figures show the die 6 screwed-in in accordance with this instruction.

The lifting plate 14 comprises a lag screw bore 22 running in the pulling direction 10 with a female thread which is also not depicted in the figures. A lag screw 24 arranged concentrically to the male thread 20 of the die 6 is screwed into this lag screw bore 22 against the pulling direction 10. An end of the lag screw 24 as seen against the pulling direction 10 is additionally screwed into the bottom 8 of the cartridge case 4. For this purpose, if the lag screw 10 is not executed as an appropriate tapping screw, a corresponding bottom bore 26 may be formed in advance or cut-in through the bottom 8 of the cartridge case 4. The lag screw 24 is thus used as pulling element to pull out the cartridge case 24, wherein the pulling element comprises a retaining member in the form of a screw thread. An alternative pulling element may be a gripper, for example.

In order to screw the lag screw 22 to the lifting plate 14, the lag screw may be fitted with a screw head 28 at the end opposite the cartridge case 4. Similarly, to increase the mechanical stability of the die 6, a locknut 30 may be screwed onto the male thread 20 of the die 6 and tightened against the support plate 12.

In the manner described above, the support plate 12 and the lifting plate 14 are held mechanically against each other via the die 6 and the cartridge case 4 held therein. In order to pull the cartridge case 4 out of the die 6 in the pulling direction 10, the support plate 12 and the lifting plate 14 must only be driven apart in or against the pulling direction 10, which could be realised with suitable drive members such as a vice which is not shown.

The present embodiment comprises the drive members with a first jack screw 32 and a second jack screw 34 which are screwed through the support plate 12 in the pulling direction 10 through a first jack screw bore 36 and a second jack screw bore 38 respectively. The two jack screws 32, 34 are arranged symmetrically to each other with the centre of the die bore 18 as the centre of symmetry.

For this purpose, the jack screws 32, 34 are screwed into the support plate 12 until a front end as seen in the pulling direction 10 touches the lifting plate 14. In this condition, the lifting plate 14 may be separated from the support plate 12 by continuing to screw the jack screws 32, 34 into the jack screw bores 36, 38, so that the above mentioned distance 16 of the plates increases, and the cartridge case 4 is thus pulled out of the die 6. Preferably, wing screws should be used as jack screws 32, 34, because they can be operated without a wrench. This, however, is not necessary. The jack screws 32, 34 may also comprise screw heads 35 which are moved using a suitable wrench.

When using the device 2 for pulling the cartridge case 4 out of the die 6, the support plate 12 should, as far as possible, always be parallel to the lifting plate 14 to prevent all screws acting in the device 2 from being tilted. This is guaranteed, on the one hand, by the said symmetrical arrangement of the jack screws 32, 34, so that the jack screws 32, 34 and the die bore 18 are arranged on a mutual line in the pulling direction 10 in a plan view of the device 2. The abovementioned locknut 30 is also an alternative or additional way of avoiding tilting.

Figure 2:
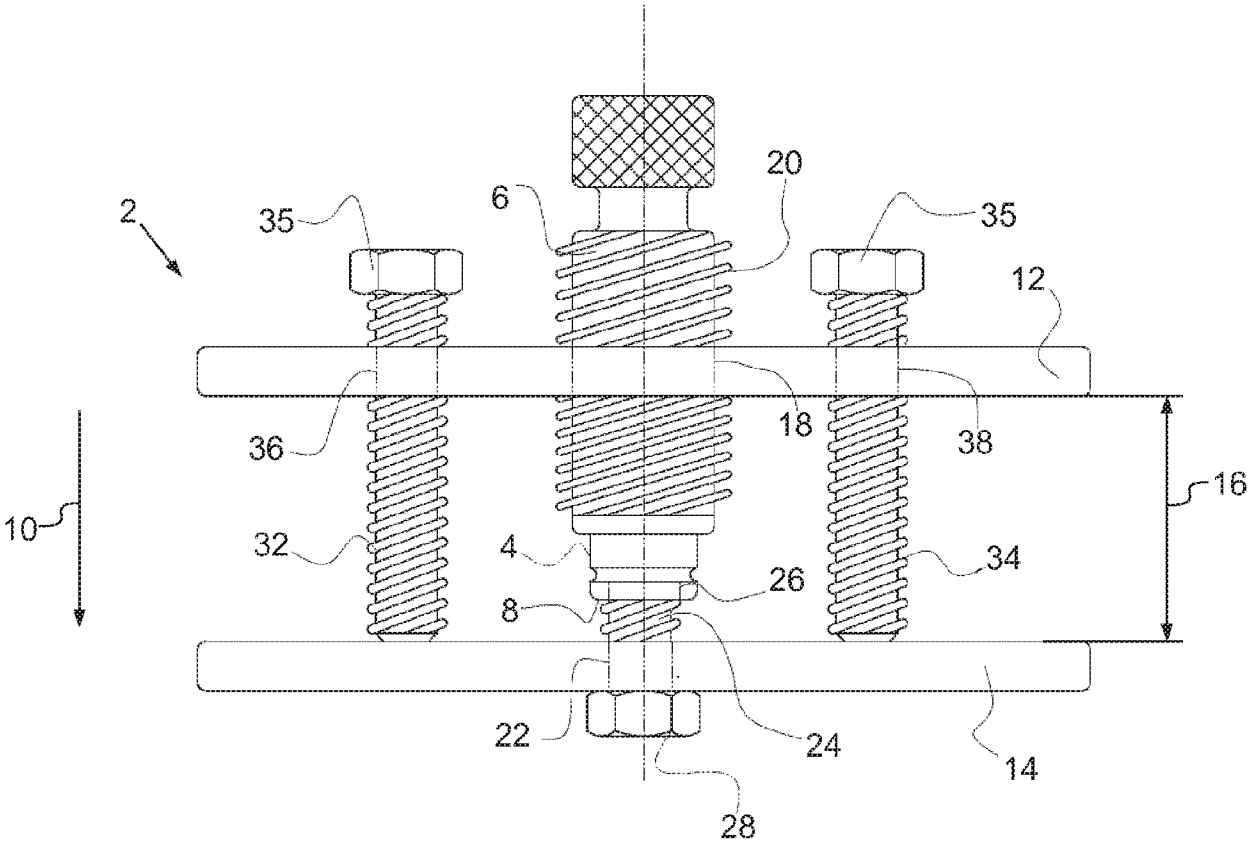
FIG. 2 a device for pulling a cartridge case out of a die in accordance with a second embodiment.

FIG. 2 shows an example of an embodiment of the device 2 without the locknut 18. This is readily feasible because the die 6 with its male thread 20 is forcibly actuated in the female thread 6 of the support plate 12 in the pulling direction, and is also fixed with a sufficiently low pitch of the male thread 20.

Figure 3:
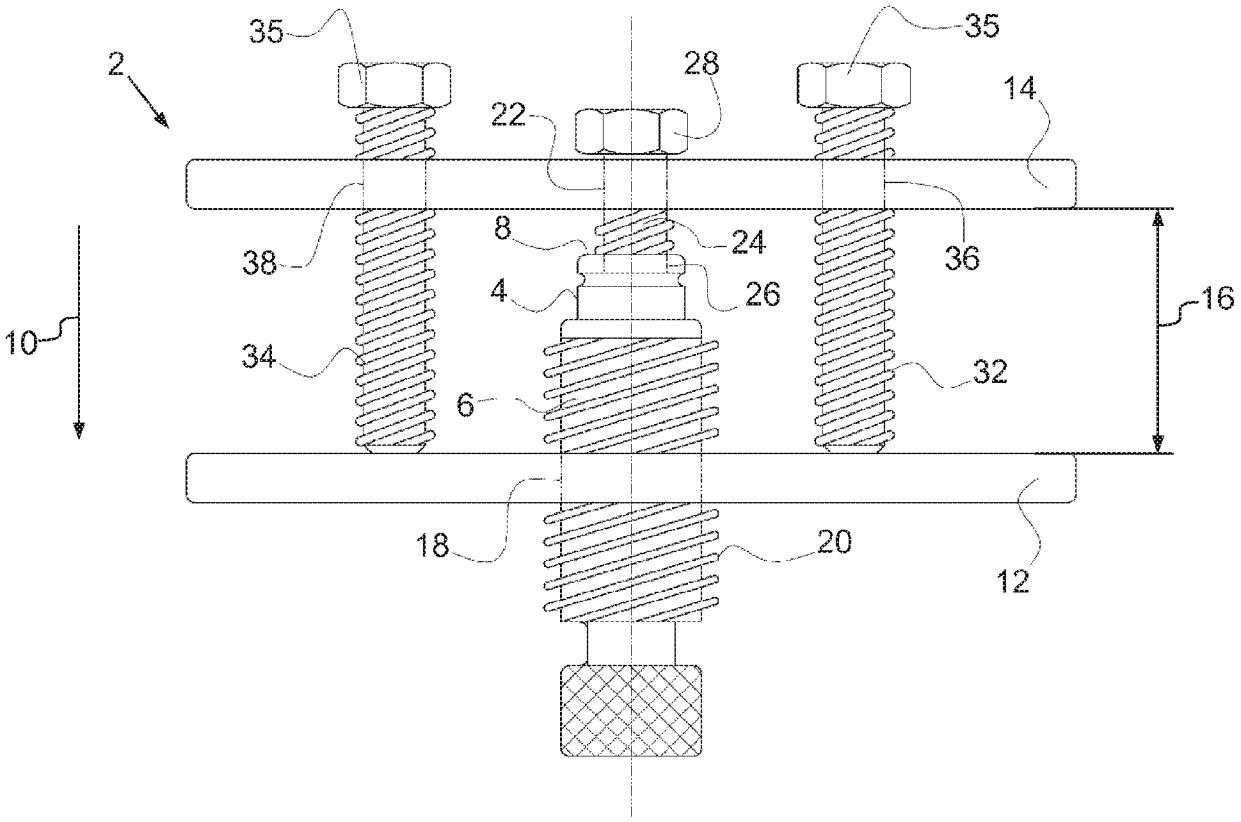
FIG. 3 a device for pulling a cartridge case out of a die in accordance with a third embodiment.

In the device 2 in accordance with FIG. 3, the jack screws 32, 34 are screwed into the lifting plate 14 against the pulling direction 10. Although the device 2 of FIG. 3 cannot be set up easily on a support such as a table, the die 6 does not disturb when the jack screws 32, 34 are rotated. The selection of the embodiment of the device 2 according to FIG. 2 or FIG. 3 may depend on the application.

Figure 4:
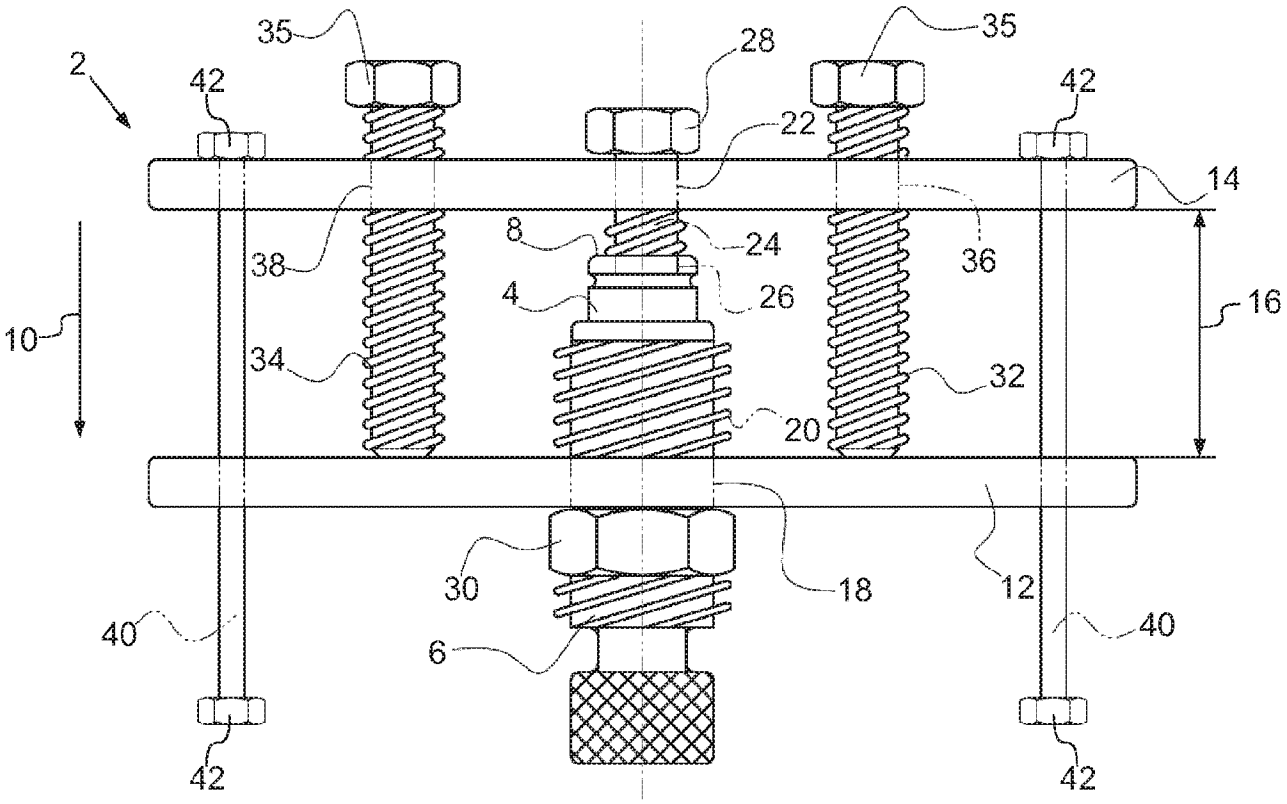
FIG. 4 a device for pulling a cartridge case out of a die in accordance with a fourth embodiment.
Figure 5:
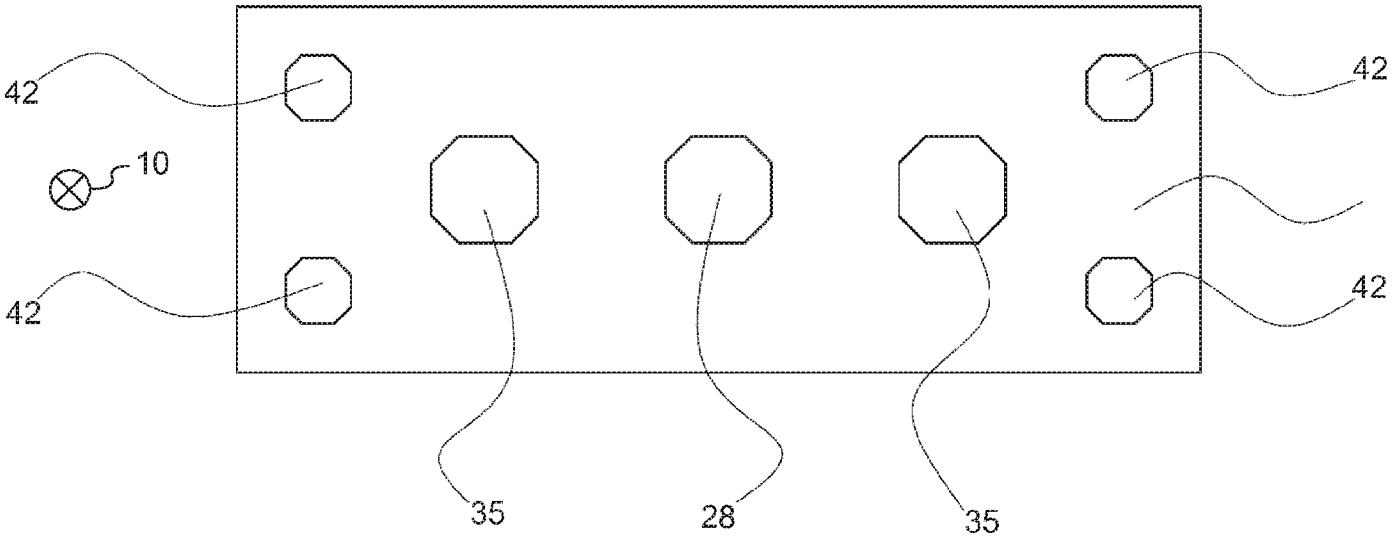
FIG. 5 a plan view on the device of FIG. 4.

FIGS. 4 and 5 show an embodiment of the device 2 based on the device 2 of FIG. 3. The embodiment shown, however, can easily be implemented in the devices 2 of FIGS. 1 and 2.

In the device 2 of the FIGS. 4 and 5, the lifting plate 14 is held against the support plate 12 by a guiding element which is independent of the said screws. The guiding element comprises four linear rails, comprising four guide pillars 40 in the present embodiment. Each guide pillar 40 comprises at their front and back end as seen in the pulling direction 10 a hexagon head 42 which may either be one piece with the guide pillar 40 or screwed onto the guide pillar 40 as a nut. As seen with regard to the die bore 18, the guide pillars 40 are arranged symmetrically to one another.

The guide pillars 40 may be fixed to the support plate 12 or the lifting plate 14, while the corresponding other lifting plate 14 or support plate 12 may slide along the guide pillars 40. Although not shown in the FIGS. 1 to 3, as already mentioned, the guide pillars 40 may also be integrated in these embodiments.

The device 2 may be used in practice, for example, as follows:

First, the bottom bore 26 is drilled into the bottom 8 of the cartridge case 4 stuck in the die 6. A thread is then cut into the bottom bore 26 of the cartridge case 4 using a tap. The lag screw 24 is then guided through the lag screw bore 22 of the lifting plate 14 and screwed into the cut thread of the bottom bore 26 of the cartridge case 4. The two jack screws 32, 34 are then screwed into the corresponding jack screw bores 36, either on the support plate 12 in the FIGS. 1 and 2 or on the lifting plate 14 in the FIGS. 3 and 4, and the die 6 is stabilized with its male thread 8 in the die bore 8. Preferably, the support plate 12 may be fixed in a vice. The two jack screws 32, 34 are then evenly screwed in, so that they are supported on the lifting plate 14 in FIGS. 1 and 2 or on the support plate 12 in FIGS. 3 and 4 respectively, and the lifting plate 14 moves away from the support plate 12 in and/or against the pulling direction 10. The cartridge case 4 is thus pulled out of the die 6 by means of the lag screw 24. If the cartridge case 4 is removed from the die 6, the lag screw 24 is removed from the bottom 8 of the cartridge case 4, and the die 6 can be reused.

In short, the invention represents a simply opportunity to remove cartridge cases which are stuck in a die.

For the expert it is obvious that modifications can easily be made to the invention.

The invention claimed is:

1. Device (2) for pulling a cartridge case (4) in a pulling direction (10) out of an axial bore of a die (6) which, as seen from the axial bore, comprises a first male thread (20) on an outside for holding the die (6) in a reloading press, comprising:

a support plate (12) having a die bore (18) with a first female thread for holding the die (6) aligned with the axial bore in the pulling direction (10) and secured against a movement in the pulling direction (10) in the die bore (18), wherein the die can be threaded with the support plate via the first female thread and the first male thread;

a lifting plate (14) having a pulling element bore with a second female thread arranged at a distance (16) from the support plate (12) as seen in the pulling direction (10) and being parallel to the support plate;

a pulling element (24) having a second male thread and having retaining members aligned against the pulling direction (10), wherein the retaining members are arranged in such a way as to hold a cartridge case (4) at an end of the pulling element (24) opposite to the lifting plate (14), wherein the pulling element can be threaded with the lifting plate via the second female thread and the second male thread and two drive members (32, 34) each disposed in a screw bore of either the support plate or the lifting plate and symmetrically to each other with the center of either the die bore or the pulling element bore to drive the support plate (12) and the lifting plate (14) apart in the pulling direction (10).

2. Device (2) as claimed in claim 1, wherein the retaining members comprise a thread which can be screwed into the cartridge case (4).

3. Device (2) as claimed in claim 1, wherein the pulling element (24) is a screw with a screw head which is screwed into the lifting plate (14) against the pulling direction.

4. Device (2) as claimed in claim 1, wherein the drive members (32, 34) comprise a jack screw (32, 34) screwed through the support plate (12) or the lifting plate (14) in the pulling direction (10) which is supported on the lifting plate (14) or the support plate (12) accordingly, wherein the lifting plate (14) or the support plate (12) can be moved in the pulling direction (10) by screwing the jack screw (32, 34) into the support plate (12) or the lifting plate (14).

5. Device (2) as claimed in claim 4, wherein the drive members (32, 34) comprise another jack screw (34, 32) screwed through the support plate (12) or the lifting plate (14) as seen from the jack screw (32, 34) opposite to the die (6) in the pulling direction (10) which is supported on the lifting plate (14) or the support plate (12), wherein the lifting plate (14) or the support plate (12) can be moved in the pulling direction (10) by screwing the two jack screws (34, 32) into the support plate (12) or the lifting plate (14).

6. Device (2) as claimed in claim 5, wherein both jack screws (32, 34) have the same distance to the die bore (6) as seen perpendicularly to the pulling direction (10).

7. Device (2) in accordance with claim 4, wherein the jack screw (9, 10) is a wing screw.

8. Device (2) in accordance with claim 4, wherein the jack screw is aligned in a guiding direction.

9. Device (2) as claimed in claim 1, wherein in a plan view two jack screws (32, 34) and the die bore (6) are arranged on the support plate (12) and the lifting plate (14) in the pulling direction (10) along a straight line.

10. Device (2) as claimed in claim 1, comprising a lock nut (30) which can be screwed onto the first male thread of the die (6) to attach the die (6) to the support plate (12).

11. Device (2) as claimed in claim 10, wherein a locknut (30) is arranged behind the support plate (12) as seen in the pulling direction (10).

12. Device (2) as claimed in claim 1, wherein the support plate (12) and the lifting plate (14) are arranged in a way that the lifting plate (14) is held against as they are guided (40) in the pulling direction (10).

13. Device (2) as claimed in claim 12, wherein a guiding element (40) comprises at least one linear rail, on which the lifting plate (14) and the support plate (12) are movable in relation to each other.

14. Device (2) as claimed in claim 13, wherein at least one linear rail is attached to the support plate (12) or the lifting plate (14).

15. Device (2) as claimed in claim 12, wherein the guiding element (40) comprises at least four linear rails which are arranged symmetrically to the centre of the die bore (6).

* * * * *